US007564375B2

(12) United States Patent
Brinton et al.

(10) Patent No.: US 7,564,375 B2
(45) Date of Patent: Jul. 21, 2009

(54) SYSTEM AND METHOD TO ASSOCIATE GEOGRAPHICAL POSITION DATA COLLECTED FROM A VEHICLE WITH A SPECIFIC ROUTE

(75) Inventors: Brett Brinton, Bellevue, WA (US); Charles Michael McQuade, Issaquah, WA (US)

(73) Assignee: Zonar Systems, Inc., Seattle, WA (US)

( * ) Notice: Subject to any disclaimer, the term of this patent is extended or adjusted under 35 U.S.C. 154(b) by 443 days.

(21) Appl. No.: 11/425,222

(22) Filed: Jun. 20, 2006

(65) Prior Publication Data

US 2006/0220922 A1 Oct. 5, 2006

Related U.S. Application Data

(63) Continuation-in-part of application No. 11/247,953, filed on Oct. 11, 2005, now Pat. No. 7,362,229, which is a continuation-in-part of application No. 10/915,957, filed on Aug. 11, 2004, application No. 11/425,222, which is a continuation-in-part of application No. 10/862,122, filed on Jun. 3, 2004, now Pat. No. 7,117,121, said application No. 10/915,957 is a continuation-in-part of application No. 10/219,892, filed on Aug. 15, 2002, now Pat. No. 6,804,626, said application No. 10/862,122 is a continuation-in-part of application No. 10/219,892, filed on Aug. 15, 2002, now Pat. No. 6,804,626, which is a continuation-in-part of application No. 09/951,104, filed on Sep. 11, 2001, now Pat. No. 6,671,646.

(51) Int. Cl.
*G08G 1/123* (2006.01)

(52) U.S. Cl. ..... 340/988; 340/572.1; 235/384; 701/29; 701/35; 701/201; 701/213; 702/182; 342/357.06

(58) Field of Classification Search ..... 340/988–990, 340/993, 995.19, 995.21; 701/207–210, 701/213, 29, 35, 201, 205; 342/357.06–357.1, 342/457; 235/384; 702/182–184
See application file for complete search history.

(56) References Cited

U.S. PATENT DOCUMENTS 4,025,791 A 5/1977 Lennington et al. ..... 250/341

(Continued)

OTHER PUBLICATIONS

"*D.O.T. Driver Vehicle Inspection Reports on your wireless phone*!" FleeTTrakkeR $_{LLC}$ 2002-2003 FleeTTrakkeR $_{LLC}$. All rights reserved <http://www.fleettrakker.com/web/index.jsp>.

(Continued)

*Primary Examiner*—Davetta W Goins
*Assistant Examiner*—Anne V Lai
(74) *Attorney, Agent, or Firm*—Ronald M. Anderson

(57) ABSTRACT

Data collected in connection with operation of a vehicle can be used to automatically determine upon which one of a plurality of predefined routes a vehicle has been operating. In one exemplary embodiment, an operator inputs identification data into a data set that also includes other types of data. The route identification data uniquely identifies the specific one of the plurality of predefined routes, enabling the route the vehicle was operating on during that time period corresponding to the data set to be determined. In a second exemplary embodiment, rather than requiring the operator to provide the route identification data, geographical position data collected during operation of a vehicle are compared with geographical position data corresponding to each one of the plurality of predefined routes until a match is found, thereby identifying the route the vehicle was operating on during collection of the geographical position data.

10 Claims, 6 Drawing Sheets

U.S. PATENT DOCUMENTS

| | | | | |
|---|---|---|---|---|
| 4,258,421 | A | 3/1981 | Juhasz et al. | 364/424 |
| 4,325,057 | A | 4/1982 | Bishop | |
| 4,763,356 | A | 8/1988 | Day, Jr. et al. | 379/368 |
| 4,799,162 | A | 1/1989 | Shinakawa | |
| 4,804,937 | A | 2/1989 | Barbiaux et al. | 340/52 F |
| 4,897,792 | A * | 1/1990 | Hosoi | 701/208 |
| 5,058,044 | A | 10/1991 | Stewart et al. | 364/551.01 |
| 5,068,656 | A | 11/1991 | Sutherland | |
| 5,206,643 | A * | 4/1993 | Eckelt | 340/932.2 |
| 5,223,844 | A | 6/1993 | Mansell et al. | 342/357.07 |
| 5,321,629 | A | 6/1994 | Shirata et al. | 702/187 |
| 5,399,844 | A | 3/1995 | Holland | 235/376 |
| 5,459,304 | A | 10/1995 | Eisenmann | 235/380 |
| 5,541,845 | A * | 7/1996 | Klein | 701/207 |
| 5,557,254 | A | 9/1996 | Johnson et al. | 340/426 |
| 5,557,268 | A | 9/1996 | Hughes et al. | 340/933 |
| 5,585,552 | A | 12/1996 | Heuston et al. | 73/116 |
| 5,600,323 | A | 2/1997 | Boschini | 341/173 |
| 5,610,596 | A | 3/1997 | Petitclerc | 340/825.23 |
| 5,671,158 | A | 9/1997 | Fournier et al. | 345/8 |
| 5,680,328 | A * | 10/1997 | Skorupski et al. | 701/35 |
| 5,719,771 | A | 2/1998 | Buck | |
| 5,731,893 | A | 3/1998 | Dominique | 359/379 |
| 5,808,565 | A | 9/1998 | Matta | |
| 5,874,891 | A | 2/1999 | Lowe | 340/433 |
| 5,942,753 | A | 8/1999 | Dell | 250/338.1 |
| 6,054,950 | A | 4/2000 | Fontana | 342/463 |
| 6,078,255 | A | 6/2000 | Dividock et al. | 340/539 |
| 6,128,959 | A | 10/2000 | McGovern et al. | 73/660 |
| 6,236,911 | B1 | 5/2001 | Kruger | 701/1 |
| 6,253,129 | B1 | 6/2001 | Jenkins | |
| 6,256,579 | B1 | 7/2001 | Tanimoto | 701/201 |
| 6,263,276 | B1 * | 7/2001 | Yokoyama et al. | 701/207 |
| 6,374,176 | B1 * | 4/2002 | Schmier et al. | 701/200 |
| 6,396,413 | B2 | 5/2002 | Hines et al. | 340/825.49 |
| 6,411,891 | B1 * | 6/2002 | Jones | 701/201 |
| 6,505,106 | B1 * | 1/2003 | Lawrence et al. | 701/35 |
| 6,594,621 | B1 | 7/2003 | Meeker | 702/185 |
| 6,597,973 | B1 | 7/2003 | Barich et al. | 701/29 |
| 6,609,082 | B2 | 8/2003 | Wagner | 702/182 |
| 6,671,646 | B2 | 12/2003 | Manegold et al. | 702/127 |
| 6,708,113 | B1 | 3/2004 | Von Gerlach et al. | 701/210 |
| 7,174,243 | B1 * | 2/2007 | Lightner et al. | 701/33 |
| 7,174,277 | B2 * | 2/2007 | Vock et al. | 702/188 |
| 7,254,516 | B2 * | 8/2007 | Case et al. | 702/182 |
| 2001/0053983 | A1 | 12/2001 | Reichwein et al. | 705/1 |
| 2002/0147610 | A1 | 10/2002 | Tabe | 705/1 |
| 2003/0030550 | A1 | 2/2003 | Talbot | 340/433 |
| 2003/0033061 | A1 | 2/2003 | Chen et al. | 701/33 |
| 2003/0109973 | A1 | 6/2003 | Hensey et al. | 701/35 |
| 2003/0120745 | A1 | 6/2003 | Katagishi et al. | 709/217 |
| 2004/0009819 | A1 | 1/2004 | Koga | 464/51 |
| 2005/0273250 | A1 | 12/2005 | Hamilton et al. | 701/200 |
| 2007/0179709 | A1 | 8/2007 | Doyle | 701/209 |
| 2008/0154489 | A1 | 6/2008 | Kaneda et al. | 701/201 |

OTHER PUBLICATIONS

"Detex Announces the Latest Innovation in Guard Tour Verification Technology." *Detex Life Safety, Security and Security Assurance*. Jan. 1, 2003. 1pp. © 2002-2004 Detex Corporation. <http://www.detex.com/NewsAction.jspa?id=3>.

"Nextel, Motorola and Symbol Technologies Offer First Wireless Bar Code Scanner for Mobile Phones." *InvoiceDealers*.

"The Data Acquisition Unit Escorte." *The Proxi Escort.com*. Nov. 20, 2001. 4pp. © 2000 GCS General Control Systems. <http://www.ges.at/eng/produkte/hw/escorte.htm>.

Albright, Brian: "Indiana Embarks on Ambitious RFID roll out." *Frontline Solutions*. May 20, 2002; 2pp. Available at: <http://www.frontlinetoday.com/frontline/article/articleDetail.jsp?id=19358>.

Contact: GCS (UK), Tewkesbury Gloucestershire. Dec. 11, 2002. 2pp. Copyright © 2000 GCS General Control Systems <http://www.gcs.at?eng/news_allegemein.htm>.

Kurtz, Jennifer. "Indiana's E-Government: A Story Behind It's Ranking." *INCONTEXT Indiana;s Workforce and Economy*. Jan.-Feb. 2003 vol. 4, No. 5pp. Available at <http://www.incontext.indiana.edu/2003/jan-feb03/governement.html>.

Quaan et al., "Guard Tour Systems." *Security Management Online*. Sep. 16, 2003. 1pg. © 2000 Available at: <http://www.securitymanagement.com/ubb/Forum30/HTML/000066.html>.

Senger, Nancy. "Inside RF/ID: Carving A Niche Beyond Asset Tracking." *Business Solutions*. Feb. 1999: 5pp. Available at: <http://www.businesssolutionsmag.com/Articles/1999_02/9902208.html>.

Spencer, Nancy. "Maximize Your Exposure." *Business Solutions*. Feb. 1999: 5pp. Available at: <http://www.businesssolutionsmag.com/Articles/1999_02/990208.htm>.

Tiscor: The Mobile Software Solutions Provider. *Inspection Manager*: an Introduction and Slide Presentation; 19pp. Available: <www/TOSCOR.com>.

Want, Roy, "RFID A Key to Automating Everything." *Scientific American* (Jan. 2004): 58-65.

"What is the Child Check-Mate Safety System?" *2002@Child Checkmate Systems, Inc*. <http://www.childcheckmate.com/what.html>.

Tsakiri, M et al. Abstract: "Urban fleet monitoring with GPS and GLONASS." *Journal of Navigation*, vol. 51, No. 3. Published Sep. 1998. 2pp. NDN-174-0609-4097-3.

Anonymous. "Transit agency builds GIS to plan bus routes." *American City & County*. vol. 118, No. 4. Published Apr. 1, 2003. 4pp. NDN-258-0053-0664-6.

Qualcomm. "Object FX Integrates TrackingAdvisor with Qualcomm's FleetAdvisor System; Updated Version Offers Benefit of Visual Display of Vehicles and Routes to Improve Fleet Productivity." Source: Newswire. Published Oct. 27, 2003. 4pp. NDN-121-0510-3002-5.

Dwyer, H.A., et al. Abstract: "Analysis of the Performance and Emissions of Different Bus Technologies on the city of San Francisco Routes." Technical paper published by Society of Automotive Engineers, Inc. Published Oct. 26, 2004. 2pp. NDN-116-0014-3890-6.

"Tracking out of route: software helps fleets compare planned routes to actual miles. (Technology)." *Commercial Carrier Journal*. Published Oct. 1, 2005. 4pp. NDN-219-1054-1717-0.

* cited by examiner

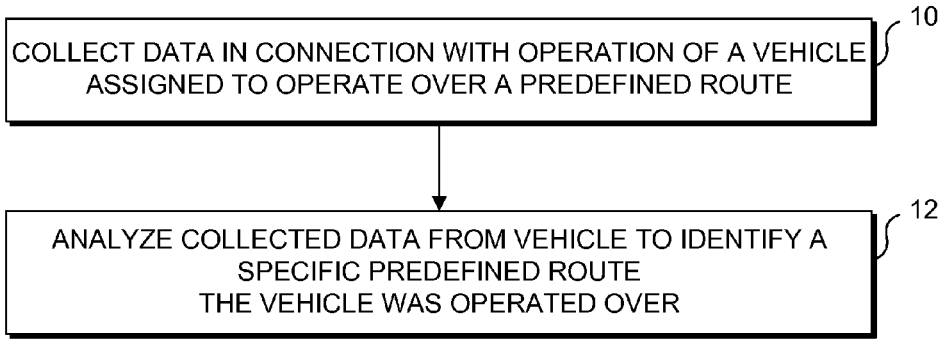
*FIG. 1*
*FIG. 2*
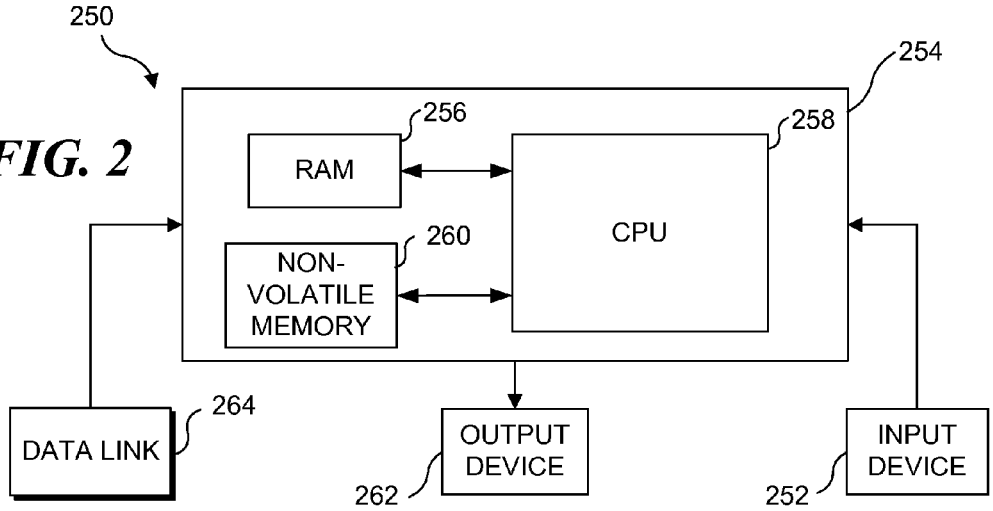
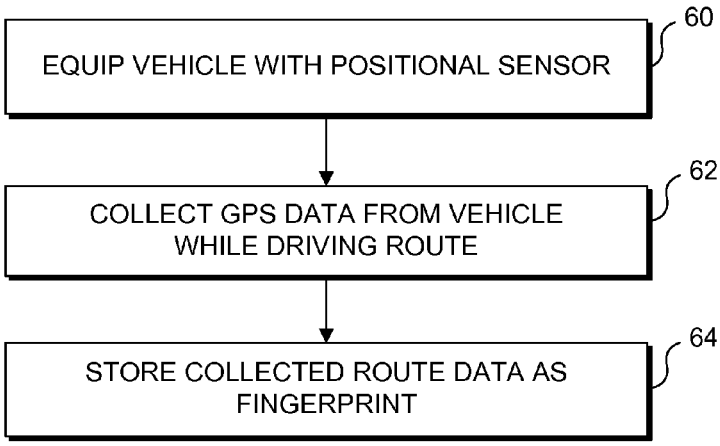
*FIG. 10*

SYSTEM AND METHOD TO ASSOCIATE GEOGRAPHICAL POSITION DATA COLLECTED FROM A VEHICLE WITH A SPECIFIC ROUTE

RELATED APPLICATIONS

This application is a continuation-in-part of prior application Ser. No. 11/247,953, filed on Oct. 11, 2005 and now issued as U.S. Pat. No. 7,362,229 on Apr. 22, 2008, which itself is a continuation-in-part of prior co-pending application Ser. No. 10/915,957, filed on Aug. 11, 2004, the benefit of the filing dates of which is hereby claimed under 35 U.S.C. § 120. This application is also a continuation-in-part of prior application Ser. No. 10/862,122, filed on Jun. 3, 2004 and now issued as U.S. Pat. No. 7,117,121 on Oct. 3, 2006, the benefit of the filing date of which is hereby claimed under 35 U.S.C. § 120. Prior co-pending application Ser. No. 10/915,957 and prior application Ser. No. 10/862,122 are also both continuation-in-parts of prior application Ser. No. 10/219,892, filed on Aug. 15, 2002 and now issued as U.S. Pat. No. 6,804,626 on Oct. 12, 2004, which itself is a continuation-in-part of prior application Ser. No. 09/951,104, filed on Sep. 11, 2001 and now issued as U.S. Pat. No. 6,671,646 on Dec. 30, 2003, the benefit of the filing dates of which is hereby claimed under 35 U.S.C. § 120.

BACKGROUND

As the cost of sensors, communications systems and navigational systems has dropped, operators of commercial and fleet vehicles now have the ability to collect a tremendous amount of data about the vehicles that they operate, including geographical position data collected during the operation of the vehicle.

Vehicle fleet operators often operate vehicles along predefined and generally invariant routes. For example, buses frequently operate on predefined routes, according to a predefined time schedule (for example, along a route that is geographically, as well as temporally defined). Fleet operators often assign specific vehicles to particular routes. Occasionally, maintenance issues necessitate changing the vehicles assigned to specific routes. It is often tedious and time-consuming for fleet operators to keep track of which route a particular vehicle has been assigned to at any given time. It would be desirable to provide such fleet operators with means for automatically determining upon what route a particular vehicle has been (or currently is) operating.

SUMMARY

One aspect of the novel concepts presented herein is a method of using data collected in connection with operation of a vehicle to automatically determine upon what route that vehicle has been operating. In a first exemplary embodiment, an operator is enabled to input route identifier data (or route identification data) into a data set that also includes other types of data. The route identification data uniquely identifies the specific one of the plurality of predefined routes (and also preferably uniquely identifies a specific vehicle). Thus, examination of the data set will enable the route identification data to be used to identify upon which one of a plurality of predefined routes the vehicle was operating during the time period corresponding to the data set. In general, the other data will be operational data relating to an operational status of the vehicle (and is not simply data that uniquely identifies the route or the vehicle). In a second exemplary embodiment, rather than requiring the operator to provide the route identification data, geographical position data collected during operation of a vehicle is compared with geographical position data corresponding to each one of the plurality of predefined routes until a match is identified, thereby identifying upon which one of the plurality of predefined routes the vehicle was operating during collection of the geographical position data.

In general, the data being analyzed that indicate the predefined route (i.e., the data set or the geographical position data) will be analyzed by a remote computing device. For example, the remote computing device can be a computing system controlled or accessed by the fleet operator. The remote computing device also can be operating in a networked environment, and in some cases, may be operated by a third party under contract with the fleet operator to perform such services. Thus, the data set including the route identification data and the other data or the geographical position data can be conveyed via a data link to the remote computing device.

The first exemplary embodiment (in which a data set comprising route identifier data and other data is analyzed to determine upon which one of the plurality of predefined routes the vehicle has been operated) can be implemented in several different ways. The basic elements involved in this exemplary embodiment include a vehicle, a vehicle operator, an identification data input means, an operational data collection means, a data link means, and a remote computing device. In general, the remote computing device can be implemented by a computing system employed by an entity operating a fleet of vehicles. Entities that operate vehicle fleets can thus use such computing systems to track and manipulate data relating to their vehicle fleet. It should be recognized that these basic elements can be combined in many different configurations to achieve the method defined above. Thus, the details provided herein are intended to be exemplary, and not limiting on the concepts disclosed herein. Two particularly useful implementations of the first exemplary embodiment involve a first alternative in which the data set is stored in a memory associated with a vehicular onboard computer, and a second alternative in which the data set is stored in a memory associated with a portable data collection device.

When the data set is stored in a memory associated with an onboard computer, the operator can input the route identifier data via a user interface, such that the route identifier data are stored in the memory of the onboard computing device. Vehicle onboard computing devices are often configured to collect data from a variety of sensors integrated into the vehicle. Such sensor data are often communicated to the onboard computer via a J-bus, although such an embodiment is intended to be exemplary, rather than limiting. Sensor data can include brake temperature data, tire pressure data, oil temperature data, engine coolant temperature data, geographic position data, and other data corresponding to operational characteristics or conditions of the vehicle. The sensor data and the route identifier data will, in this exemplary embodiment, be combined into a data set unique to a specific operational period for a specific vehicle.

The data set is then conveyed to a remote computing device for subsequent analysis of the data set, including analysis that identifies upon which one of the plurality of predefined routes the vehicle was operating over during the period the data set was collected. The data set can be conveyed to the remote computing device in a variety of ways. Further, the data set can be extracted or conveyed from the onboard computing device, for example, using a wireless communication (such as radio frequency and IR data transfer), a hardwired interface, or by storage on portable memory storage media that can be physically moved to a desired location for data retrieval. If desired, the data set can be transmitted to the remote computing device in real-time, if the vehicle is equipped with radio or cellular communication capability. The remote computing device will parse the data set to locate the route identifier data, thereby enabling identification of which one of the plurality of predefined routes matches the route identifier data, such that a specific one of the plurality of predefined routes can be identified as corresponding to the specific period during which the data set was collected.

When the data set is stored in a memory associated with a portable electronic data collection device, the operator can input the route identifier data via a user interface, such that the route identifier data are stored in the memory of the portable electronic data collection device. Such a portable electronic data collection device can be used not only to store the route identifier data, but also to collect and store other data collected in connection with the operation of the vehicle. The other data and the route identifier data will typically be combined into a data set unique to a specific operational period for a specific vehicle. The use of a portable electronic data collection device to collect inspection related data has been described in detail in commonly assigned U.S. Pat. No. 6,671,646, entitled SYSTEM AND PROCESS TO ENSURE PERFORMANCE OF MANDATED SAFETY AND MAINTENANCE INSPECTIONS, the specification and drawings of which are hereby specifically incorporated herein by reference. The use of a portable electronic data collection device to collect ancillary data (including sensor data such as brake temperature data, tire pressure data, oil temperature data, engine coolant temperature, geographic position data, and other data corresponding to operational characteristics and condition of the vehicle) has been described in detail in commonly assigned U.S. patent application Ser. No. 11/247,953, entitled ENSURING THE PERFORMANCE OF MANDATED INSPECTIONS COMBINED WITH THE COLLECTION OF ANCILLARY DATA, the specification and drawings of which are hereby specifically incorporated herein by reference. The data set is then conveyed to a remote computing device for subsequent analysis of the data set, including analysis configured to identify which one of the plurality of predefined routes the vehicle was operating over during the period the data set was collected. The data set can be conveyed to the remote computing device in a variety of different ways. The data set can be extracted from the portable electronic data collection device using a wireless communication (such as radio frequency and IR data transfer), a hard-wired interface, or portable memory storage media that can be moved to another location to extract the data. If desired, the data set can be transmitted to the remote computing device in real-time, if the portable electronic data collection device or vehicle is equipped with radio or cellular communication capability. The remote computing device will parse the data set to locate the route identifier data, thereby enabling identification of which one of the plurality of predefined routes matches the route identifier data, such that a specific one of the plurality of predefined routes can be identified as corresponding to the specific period during which the data set was collected.

With reference to the second exemplary embodiment, in which the data comprises geographical position data (as opposed to a data set comprising route identifier data and other data, where the other data itself might be geographical position data), a method is employed that will enable an operator of fleet vehicles to use GPS data (or other position data) collected from a vehicle to determine a predefined route that is associated with the collected data. Initially, GPS data (or other position data) for each predefined route operated by a fleet operator will be collected (and generally stored in a memory accessible by the remote computer). Significantly, while some routes may share one or more GPS data points in common (because of overlapping portions of the routes), each route will be defined by a unique collection of GPS data points (i.e., each route will exhibit a unique fingerprint of points along the route). When the GPS data collected by a particular vehicle are analyzed, the data can quickly be correlated with a particular route/fingerprint to enable a fleet operator to rapidly determine the route completed by the vehicle. The GPS data collected by each vehicle can include an identifier uniquely identifying the vehicle that collected the data. The route data defining the fingerprint can include geographical position data only, or positional data and temporal data. The addition of temporal data will be useful when a fleet operator has numerous routes that share common positional features. The additional metric of time will enable routes having common geographic data to be more readily distinguishable. In at least one exemplary embodiment, the initial position data collected for a route will be generated by equipping a vehicle with a positional tracking unit (such as a GPS tracking system), and operating the vehicle over the desired route to generate the route data (i.e., the fingerprint of geographical position data, which may also comprise temporal data).

Another aspect of the novel concepts presented herein is directed to a system and apparatus implementing the functional steps generally as described above.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein:

FIG. 1 is a high level logic diagram showing exemplary overall method steps implemented in accord with the concepts disclosed herein to identify a specific predefined route over which a vehicle has been operated by analyzing data collected in connection with operation of the vehicle;

FIG. 2 is a functional block diagram of an exemplary computing device that can be employed to implement some of the method steps disclosed herein;

Figure 3:
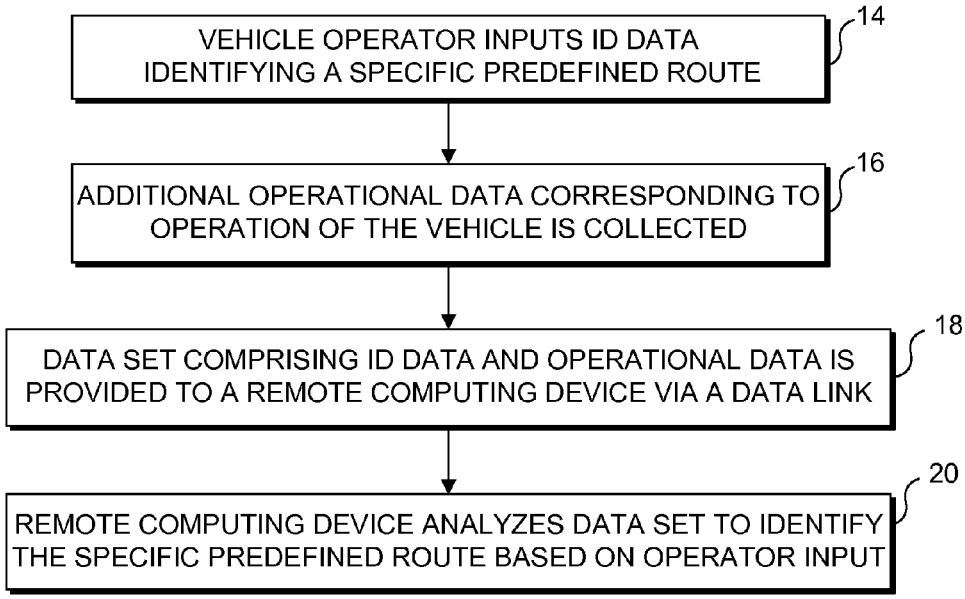
FIG. 3 is a flow chart showing method steps implemented in a first exemplary embodiment in which the data being analyzed comprise a data set including route identifier data input by an operator and additional data.
Figure 5A:
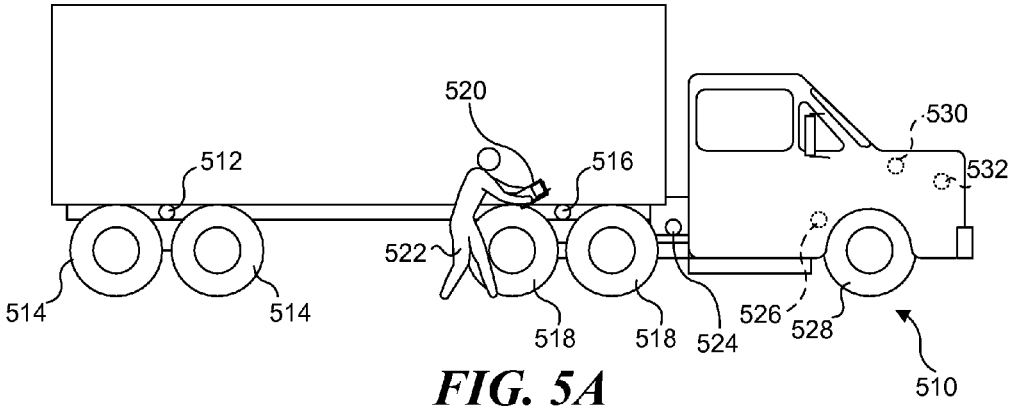
FIG. 5A is a schematic diagram of a tractor and trailer equipped with tokens at each component to be inspected, illustrating a person using a portable electronic data collection device to collect other data to be incorporated into a data set along with route identification data, generally in accord with the method steps of FIG. 3.
Figure 5B:
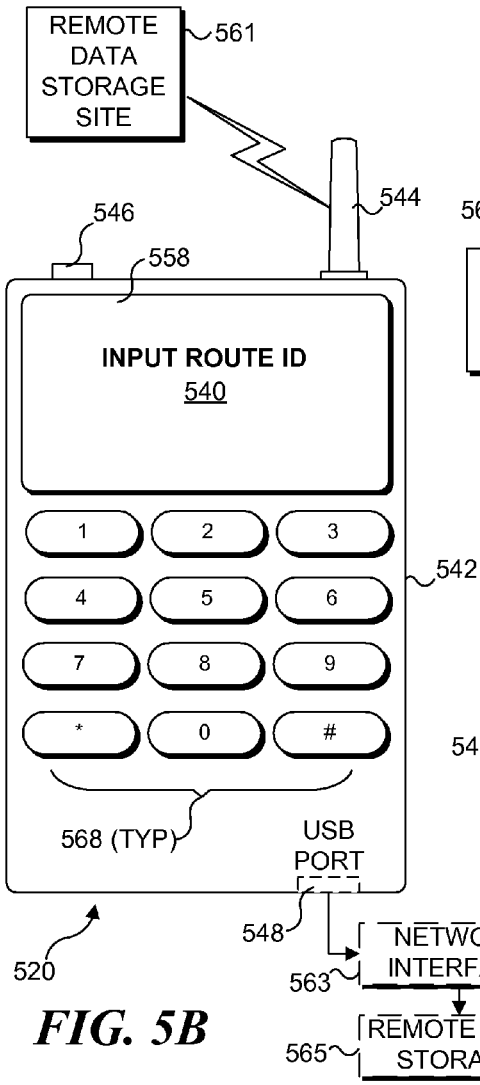
Figure 5C:
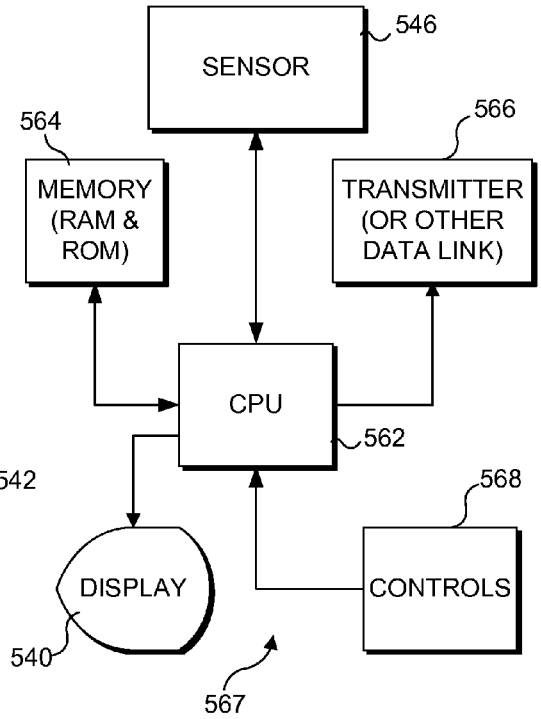
Figure 5D:
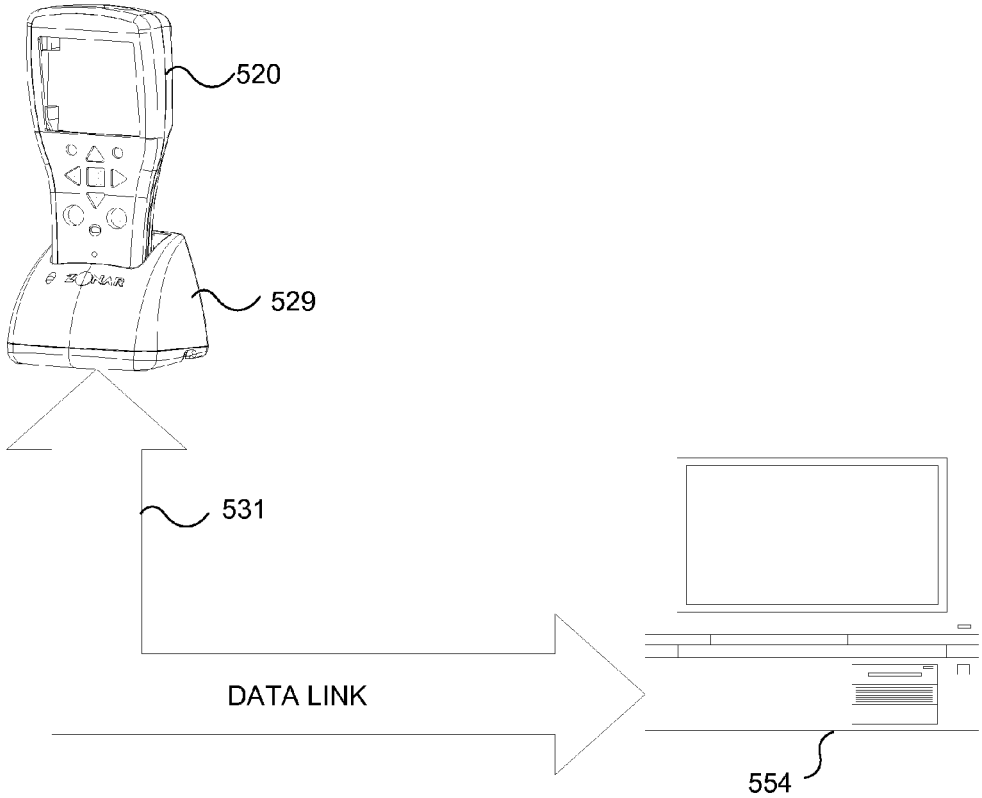
Figure 6:
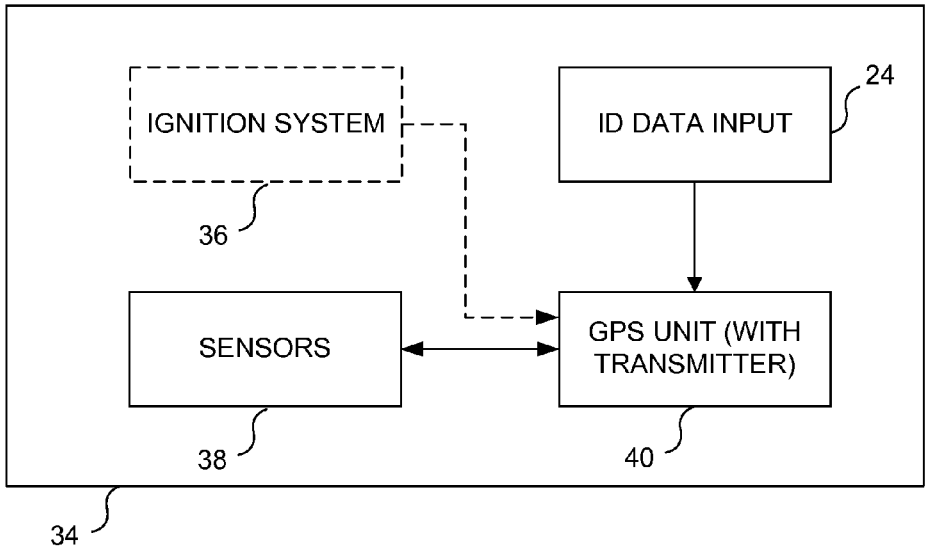
Figure 7:
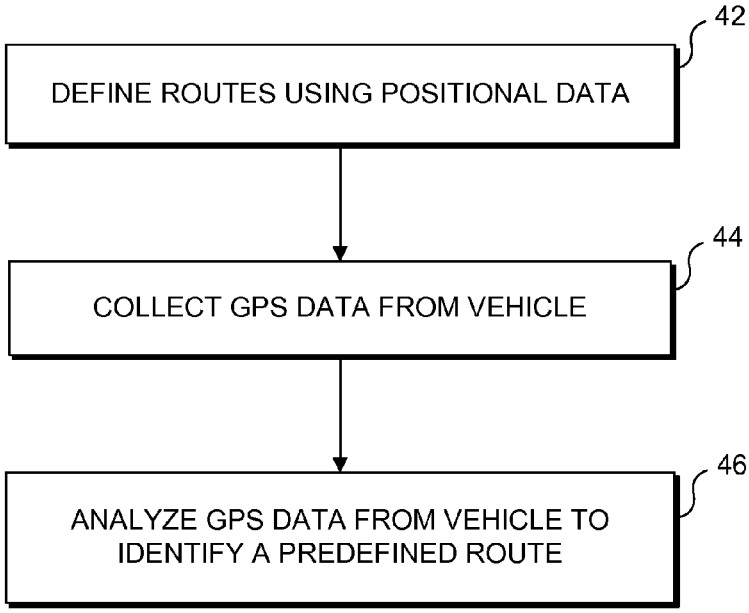
Figure 8:
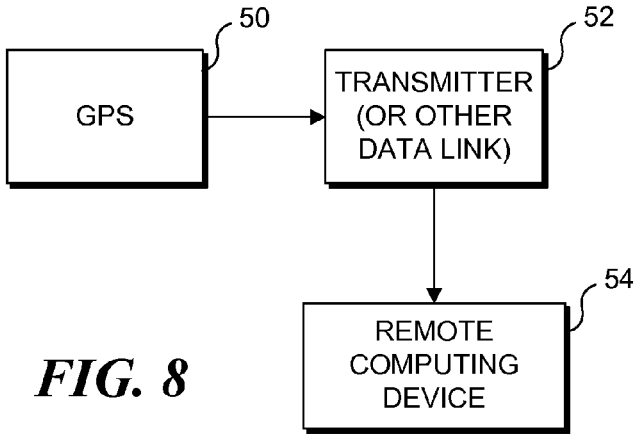
Figure 9:
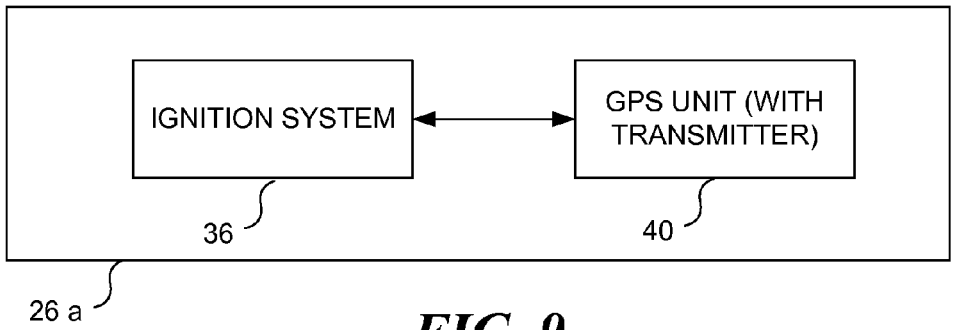

FIG. 5B is a top plan view of a portable device for use in making a safety inspection of a vehicle, showing a message that prompts the operator to input route identification data into the portable electronic data collection device, such that the route identification data are combined with inspection data to achieve a data set corresponding to a specific vehicle for a specific period of time, generally in accord with the method steps of FIG. 3;

FIG. 5C is a schematic block diagram of the functional components included in the portable device of FIG. 5B;

FIG. 5D is a schematic diagram of an exemplary system for transferring a data set from a portable electronic data collection device over the Internet, between the portable electronic data collection device that is disposed in a docking station and storage on a remote computing device;

FIG. 6 is a functional block diagram showing how a plurality of functional elements, different than those illustrated in the examples of FIGS. 4A-4D, can be configured to also implement the method steps of FIG. 3;

FIG. 7 is a flow chart showing method steps implemented in a second exemplary embodiment, in which the data being analyzed comprise geographical position data collected from the vehicle during the vehicle's operation, which is then compared to geographical position data corresponding to a plurality of the predefined routes, enabling the route over which the vehicle has been operated during collection of the geographical position data to be identified;

FIG. 8 is a schematic block diagram of exemplary functional components employed to implement the method steps of FIG. 7;

FIG. 9 is a schematic block diagram of an exemplary vehicle configured to collect the geographical position data employed in the method steps of FIG. 7; and FIG. 10 is a flow chart showing exemplary method steps implemented to generate a fingerprint comprising geographical position data for each one of the plurality of predefined routes, so that the fingerprints can be compared to the geographical position data collected from a vehicle to identify which one of the plurality of predefined routes the vehicle traversed while the geographical position data were collected.

DESCRIPTION

Figures and Disclosed Embodiments are Not Limiting

Exemplary embodiments are illustrated in referenced Figures of the drawings. It is intended that the embodiments and Figures disclosed herein are to be considered illustrative rather than restrictive.

FIG. 1 is a high level flow chart showing the overall method steps implemented in accord with one aspect of the concepts disclosed herein. In a block 10, data are collected in connection with the operation of the vehicle assigned to operate over a predefined route. In a block 12, the collected data are analyzed to identify a specific predefined route over which the vehicle has been operated. Such a method will enable operators of a fleet of vehicles to be able to analyze data collected from their vehicle fleet to determine which vehicle was operated over a specific predefined route. While specific vehicles are often assigned to specific routes, occasionally, maintenance issues or other events necessitate changing the vehicles assigned to specific routes. The method disclosed herein provides an alternative to the often tedious and time-consuming prior art techniques implemented by fleet operators to keep track of which route a particular vehicle was assigned to at any given time.

It should be recognized that the method steps of FIG. 1 can be implemented in a variety of different ways to enable the analysis of data collected in connection with operation of a vehicle, to automatically determine upon what route that vehicle has been operating. In a first exemplary embodiment, an operator is enabled to input route identifier data into a data set that also includes other types of data. Examination of the data set will enable the route identifier data to be used to identify upon which one of a plurality of predefined routes the vehicle was operating during the time period corresponding to the data set. In a second exemplary embodiment, geographical position data collected during operation of a vehicle are compared with geographical position data corresponding to each one of the plurality of predefined routes until a match is identified, thereby identifying upon which one of the plurality of predefined routes the vehicle was operating during collection of the geographical position data.

In general, analysis of the data to determine the predefined route (i.e., the data set or the geographical position data) will be carried out by a remote computing device. In general, the remote computing device in at least one embodiment is a computing system controlled or accessed by the fleet operator. The remote computing device can be operating in a networked environment, and in some cases, may be operated by a third party under contract with the fleet operator to perform such services. FIG. 2 schematically illustrates an exemplary computing system 250 suitable for use in implementing the method of FIG. 1 (i.e., for executing step 12 of this method). Exemplary computing system 250 includes a processing unit 254 that is functionally coupled to an input device 252 and to an output device 262, e.g., a display (which can be used to output a result to a user, although such a result can also be stored). Processing unit 254 comprises, for example, a central processing unit (CPU) 258 that executes machine instructions for carrying out an analysis of data collected in connection with operation of the vehicle to determine upon which one of the plurality of predefined routes the vehicle has been operated in conjunction with acquisition of the data. The machine instructions implement functions generally consistent with those described above with respect to step 12 of FIG. 1, as well as those described below, with respect to FIGS. 3 and 7. CPUs suitable for this purpose are available, for example, from Intel Corporation, AMD Corporation, Motorola Corporation, and other sources, as will be well known to those of ordinary skill in this art.

Also included in processing unit 254 are a random access memory (RAM) 256 and non-volatile memory 260, which can include read only memory (ROM) and may include some form of memory storage, such as a hard drive, optical disk (and drive), etc. These memory devices are bi-directionally coupled to CPU 258. Such storage devices are well known in the art. Machine instructions and data are temporarily loaded into RAM 256 from non-volatile memory 260. Also stored in the memory are an operating system software and ancillary software. While not separately shown, it will be understood that a generally conventional power supply will be included to provide electrical power at a voltage and current level appropriate to energize computing system 250.

Input device 252 can be any device or mechanism that facilitates user input into the operating environment, including, but not limited to, one or more of a mouse or other pointing device, a keyboard, a microphone, a modem, or other input device. In general, the input device will be used to initially configure computing system 250, to achieve the desired processing (i.e., to identify a specific route over which the vehicle has been operated). Configuration of computing system 250 to achieve the desired processing includes the steps of loading appropriate processing software into non-volatile memory 260, and launching the processing application (e.g., loading the processing software into RAM 256 for execution by the CPU) so that the processing application is ready for use. Output device 262 generally includes any device that produces output information, but will most typically comprise a monitor or computer display designed for human visual perception of output. Use of a conventional computer keyboard for input device 252 and a computer display for output device 262 should be considered as exemplary, rather than as limiting on the scope of this system. Data link 264 is configured to enable data collected in connection with operation of a vehicle to be input into computing system 250 for subsequent analysis to identify a specific route over which the vehicle has been operated. Those of ordinary skill in the art will readily recognize that many types of data links can be implemented, including, but not limited to, universal serial bus (USB) ports, parallel ports, serial ports, inputs configured to couple with portable memory storage devices, FireWire ports, infrared data ports, wireless data ports such as Bluetooth™, network connections such as Ethernet ports, and Internet connections.

FIG. 3 is a high level flow chart showing the overall method steps implemented in accord with the first exemplary embodiment for implementing the method steps of FIG. 1, in which a data set comprising route identifier data and other data is analyzed to determine what route a vehicle was traversing in connection with collection of the data set. In a block 14, a user (hereafter referred to as the operator, since generally, the user will be the operator of the vehicle, although it should be recognized that other individuals, such as fleet maintenance personnel or supervisors, can be assigned to carry out this and other tasks discussed herein) inputs route identification data into a memory, so that the route identification data can be combined with other data to generate a data set corresponding to a specific vehicle operated during a specific period of time. As described in greater detail below, the memory can be incorporated into the vehicle (such as memory associated with an onboard computer), or the memory can be associated with a portable electronic device (such as a portable electronic data collection device used by the operator to collect the other data). In a block 16, additional data corresponding to operation of the vehicle are collected. As described in greater detail below, these other data can comprise a wide variety of different data types. The data can be collected before the vehicle is operated over a specific predefined route (such as pre-trip vehicle inspection data), or the data can comprise operational parameters collected during operation of the vehicle over a specific predefined route (data such as brake temperature data, engine temperature data, coolant temperature data, tire pressure data, and geographical position data, although it should be recognized that such data types are intended to be exemplary, rather than limiting on the scope of this approach), or both (as well as various combinations and permutations of the above). In a block 18, a data set comprising the route identification data and the operational data (i.e., the other data) is conveyed to a remote computing device via a data link. It should be recognized that, depending on the specific configuration of the vehicle, the data set can be conveyed after a trip over a specific predefined route has been completed, or in real-time while the route is being traveled by the vehicle (the real-time embodiment requires a vehicle to be equipped with a wireless communications data link). In a block 20, the data set is analyzed to identify a specific predefined route over which the vehicle has been operated (i.e., the data set is parsed to identify the route identification data, which are then used to identify a particular one of the plurality of predefined routes over which the vehicle traveled).

Figure 4A:
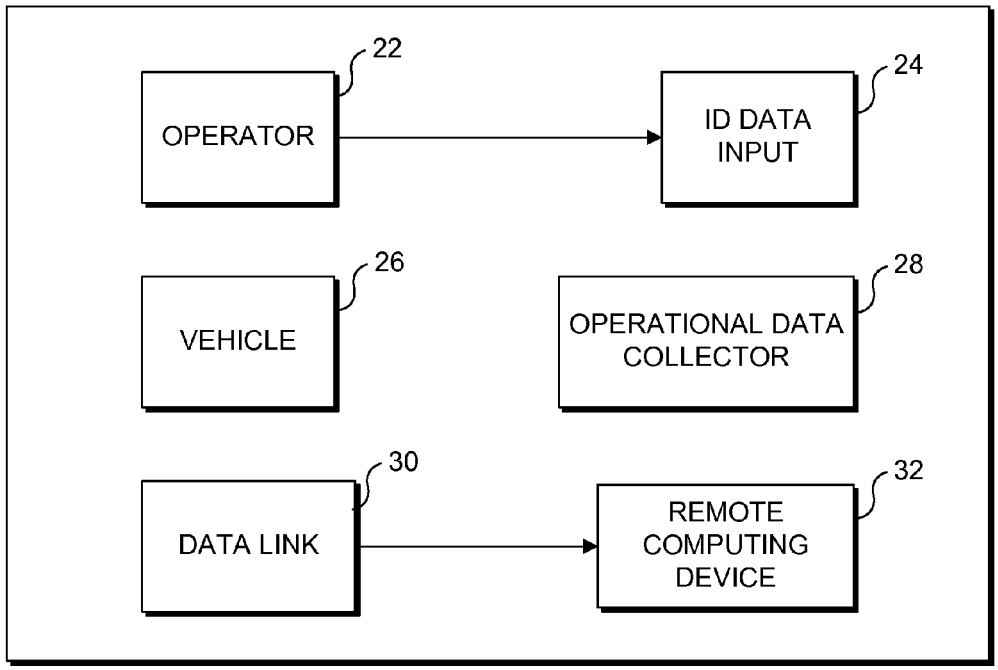
FIGS. 4A-4D are exemplary functional block diagrams showing how a plurality of functional elements can be configured differently to implement the method steps of FIG. 3.

FIGS. 4A-4D are functional block diagrams showing how a plurality of functional elements can be configured differently to implement the method steps of FIG. 3. FIG. 4A shows the basic functional elements, which include an operator 22, a route identification data input 24, a vehicle 26, an operational data collector 28 (i.e., an element configured to collect the other data that are not the route identification data), a data link 30, and remote computing device 32. Those of ordinary skill in the art should readily recognize that these functional elements can be combined in a plurality of different configurations to implement the method steps of FIG. 3.

Figure 4B:
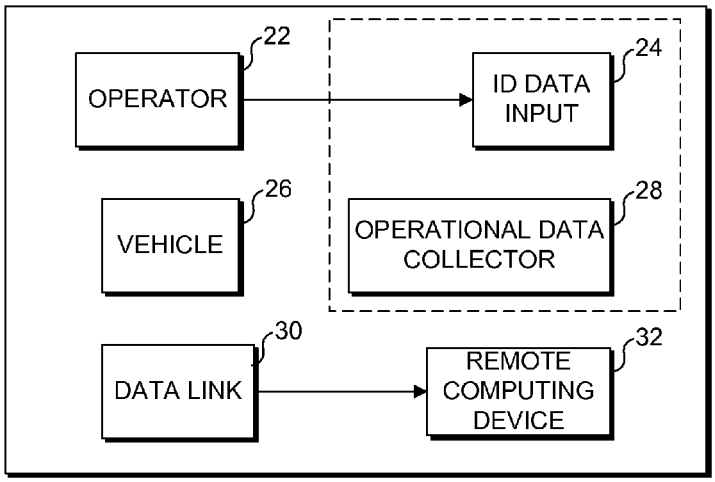

FIG. 4B schematically illustrates a first such configuration in which route identification data input 24 and operational data collector 28 are implemented in a portable electronic data collection device used by the operator to both input the route identification data into the portable electronic data collection device, and to collect and store the operational data (i.e., the other data in a data set, where the data set comprises both the route identification data and the other data collected in connection with the operation of the vehicle). As noted above, the use of a portable electronic data collection device to collect both inspection data and ancillary data related to the operation of the vehicle is described in commonly assigned patent applications that have above specifically been incorporated herein by reference. The use of a portable electronic data collection device represents a particularly efficient exemplary embodiment (i.e., an alternative corresponding to the first exemplary embodiment in which the data analyzed by the remote computing device to determine a specific one of the plurality of predefined rights comprises route identification data and other data).

In conjunction with collecting the operational data (i.e. the other data), the operator will import the route identification data into the handheld electronic data collection device. It should be recognized that the route identification can be entered before the operational data are collected, the route identification data can be entered contemporaneously with the collection of the operational data, or the route identification data can be entered after the operational data have been collected. Generally, the route identification data are entered in connection with the operation of the vehicle over one of the plurality of predefined routes. Whenever the vehicle is subsequently operated over a different one of the plurality of predefined routes, the data set (comprising the route identification data and the operational data) corresponding to the earlier used route of the plurality of predefined routes must be kept separate from the data set corresponding to a different one of the plurality of predefined routes.

In general, route identification data input 24 comprises a keyboard or function keys incorporated into a portable electronic data collection device, and the route identification data are input as an alphanumeric sequence or numerical sequence. It should be recognized however, that other data input structures (i.e., structures other than keyboards) can instead be implemented, such that the concepts presented herein are not limited to any specific identification data input device. The operator can also use the handheld electronic data collection device to scan a token that uniquely corresponds to a specific one of the plurality of the predefined routes. For example, the operator can be provided with a plurality of tokens, each of which uniquely corresponds to one of the plurality of predefined routes, such that the user selects the appropriate token, and uses the handheld electronic data collection device to scan the appropriate token. Many different tokens/sensor combinations can be implemented. Barcodes and optical scanners represent one combination, while radio frequency identification (RFID) tags and RFID readers represent another such combination. The advantage of a token/sensor combination is that the handheld electronic data collection device is not required to incorporate a keypad for entry of the route identification data. As a further alternative, the route identification data can be entered verbally, using voice recognition software in the handheld electronic collection device to recognize the verbal input. In embodiments where the route identification data is entered into a portable electronic data collection device, preferably the portable electronic data collection device is also employed to collect the operational data (i.e., operational data collector 28 is part of a portable electronic data collection device). The operational data can include inspection data and/or data collected by sensors incorporated into the vehicle (configured to collect data such as engine temperature data, oil temperature data, brake temperature data, tire pressure data, tire temperature data, and geographical position data; recognizing that such data types are intended to be exemplary rather than limiting). Preferably, operational data collector 28 comprises a sensor responsive to a token on the vehicle. As disclosed in detail in commonly assigned U.S. patent applications that have above been incorporated herein by reference, the token can simply indicate that an operator was proximate the token (i.e., the other data simply confirm that the operator was proximate the token), or the token can be configured to provide ancillary data collected by a sensor that is logically coupled to the token.

Figure 4C:
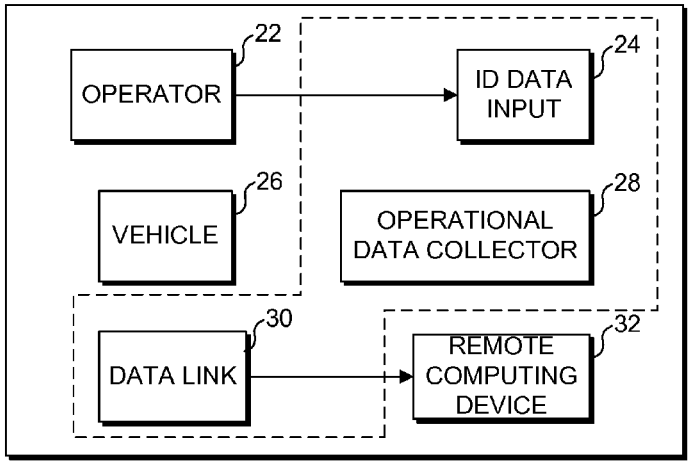

FIG. 4C corresponds to an alternative configuration for the functional elements implemented in the first exemplary embodiment (wherein the data set comprises route identification data and other data). In this alternative configuration, data link 30 has been incorporated into the portable electronic data collection device (which also comprises identification data input 24 and operational data collector 28). Those of ordinary skill in the art will recognize that such a data link can be implemented in a variety of different fashions, including, but not limited to, serial data ports, parallel data ports, USB data ports, infrared communication ports, Firewire ports, and/or radio frequency transmitter/receivers.

Figure 4D:
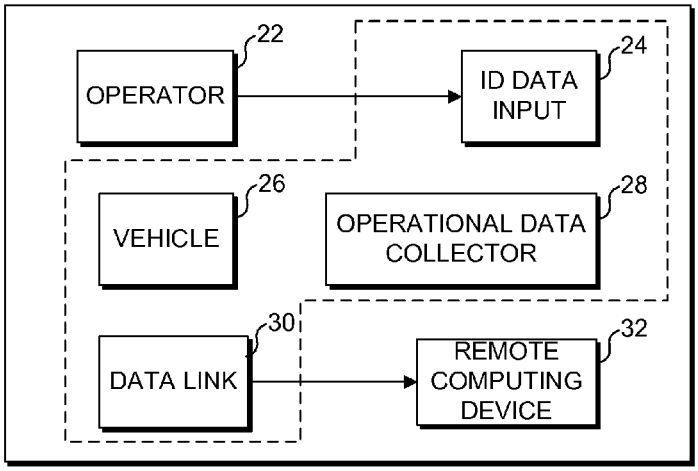

FIG. 4D corresponds to yet another alternative configuration for the functional elements implemented in the first exemplary embodiment (wherein the data set comprises route identification data and other data). In such an alternative configuration, the route identification data input, the operational data collector, and the data link can be incorporated into the vehicle. An exemplary implementation of such an alternative configuration is a vehicle equipped with a global positioning satellite (GPS) unit including a wireless transmitter (as the data link, although as discussed above in detail, it should be recognized that other data links can be alternatively employed). Such a GPS unit can include a keypad, a touchpad, (or one of the alternative input device discussed above in detail) enabling the operator to input the route identification data. During operation of the vehicle, the GPS unit will collect geographical positional data. The data set will thus comprise geographical position data (the other data/operational data) and the route identification data.

With respect to FIGS. 5A-5D, described in detail below, it should be recognized that additional details relating to such figures can be found in commonly assigned U.S. Pat. No. 6,671,646, entitled SYSTEM AND PROCESS TO ENSURE PERFORMANCE OF MANDATED SAFETY AND MAINTENANCE INSPECTIONS, the disclosure and drawings of which have been specifically incorporated herein by reference.

FIG. 5A is a schematic diagram of a tractor and trailer equipped with tokens at each component to be inspected, illustrating a person using a portable electronic data collection device to collect other data to be incorporated into a data set along with route identification data, generally in accord with the method steps of FIG. 3. FIG. 5A illustrates a tractor-trailer 510 with which a portable electronic data collection device is usable to carry out a safety inspection such that the other data in the data set (the data set comprising route identification data and other data) comprise inspection data. Tractor-trailer 510 is provided with a plurality of tokens affixed adjacent to each checkpoint or component that is to be inspected. While only a few of the tokens are illustrated in FIG. 1, it should be recognized that most inspections will include additional tokens enabling the operator to be in compliance with the DOT regulations regarding pre- and post-inspections of such vehicles. A token can be affixed adjacent to the components and systems requiring inspection, although several components might be associated with the same token. For example, in the engine compartment, one token might be used for providing inspection of both the radiator and the belts. As a driver moves about the tractor and trailer, evidence that the driver or the person doing the inspection moved sufficiently close to the components being inspected so that the inspection could actually take place is recorded in a portable device 520 (first exemplary embodiment). Regardless of either the number of components, checkpoints and systems that are associated with each token, all such components, checkpoints and systems requiring inspection, and their associated tokens, are physically located on the vehicle. Further details of portable device 520 and of other related embodiments are described below.

For the few tokens illustrated in FIG. 5A, the relevance of the disposition of the token adjacent to a corresponding component of the tractor-trailer 510 should be evident. For example, token 512 is disposed adjacent to tandem dual rear tires 514 on the trailer. Since all the tires of the tandem dual rear wheels on the left rear of the trailer are readily visible from a position adjacent to token 512, a single token is sufficient to determine that the driver was sufficiently close so that all four tires at the left rear of the trailer could be readily inspected. Similarly, tandem dual wheels 518 on the left rear of the tractor are readily inspected when an observer 522 is positioned as shown in FIG. 5A. In this position, the observer moves portable device 520 within a maximum predefined range of token 516, which is exposed above tandem dual rear wheels 518. Portable device 520 detects and responds to token 516, recording data indicating that the driver was in a position to inspect tandem dual rear wheels 518 on the tractor. It is contemplated that the operator may initiate the recognition of a token by activating a switch, or the portable device can instead simply automatically respond when a token is sufficiently close to the portable device.

Other tokens 524, 526, 530, and 532 are illustrated adjacent other components of the tractor that are part of the safety inspection. For example, token 526 is affixed adjacent to a tire 528, on the right front of the tractor, while tokens 530 and 532 are accessible if the front hood of the tractor is opened and are disposed adjacent the hydraulic brake master cylinder and the engine belts/radiator, respectively (not shown separately). For each token, there is a predetermined maximum distance that portable device 520 can be held from the token that will enable the portable device to detect the token, and thus, the component that is associated with it in order to produce a record as evidence that the person holding the portable device was in a position to inspect the component. Depending upon the component to be inspected and the type of token, different predetermined maximum distances may be assigned to the various components. The different predetermined maximum distances might be implemented by partially shielding a token to vary the distance at which the portable device can detect the token.

FIG. 5B is a top plan view of a portable device for use in making a safety inspection of a vehicle, showing a message that prompts the operator to input route identification data into the portable electronic data collection device, such that the route identification data are combined with inspection data to achieve a data set corresponding to a specific vehicle for a specific period of time, generally in accord with the method steps of FIG. 3. While FIG. 5B indicates that an exemplary portable electronic data collection device includes a keyboard-based route identification data input, it should be recognized that the other data input structures or devices discussed in detail above can alternatively be employed. As part of the inspection (or before the inspection, or after the inspection, but sometime in conjunction with the operation of the vehicle over one of the plurality of predefined routes), operator 522 is prompted to input the route identification data by a message 558 appearing on a display 540 of portable device 520, for example, using a keypad 568, as shown in FIG. 5B. Display 540 can also be used to prompt the operator to move to a different inspection location. For example, if operator 522 has just completed the inspection of tandem dual tires 514 on the left rear of the truck, display 540 can provide a prompt indicating that the operator should "verify tire condition—left rear of tractor." A sensor 546 on portable device 520 responds to token 516 when the portable device is held less than the predetermined maximum distance from token 516 by producing a signal indicating that the portable device was within the required range of tandem dual tires 518 to enable the operator to inspect the tires.

Display 540 is disposed on a front surface of a housing 542 of portable device 520. Sensor 546 is disposed on the top edge of housing 542, while an optional USB port 548 is disposed on the bottom edge of housing 542, opposite sensor 546. An antenna 544 is also disposed on the top edge of the housing for transmitting radio frequency (RF) transmissions to a remote data storage site 561 that is used for long-term storage of data resulting from safety inspections, which corresponds to the functional block diagram configuration of FIG. 4C. The data produced by a safety inspection indicate each of the components of the vehicle (or other system or apparatus being inspected) that were visited by the operator, so that the portable device was positioned within the predetermined maximum distance from the token associated with the component, and further indicates the status of the component entered by the operator (or automatically recorded).

FIG. 5C is a schematic block diagram of the functional components included in the portable device of FIG. 5B. Thus, FIG. 5C illustrates functional components 567 that are included in portable device 520, either on or inside housing 542. A central processing unit (CPU) 562 comprises the controller for portable device 520 and is coupled bi-directionally to a memory 564 that includes both RAM and ROM. Memory 564 is used for storing data in RAM and machine instructions in ROM that control the functionality of CPU 562 when the machine instructions are executed by it. CPU 562 is also coupled to receive operator input from controls 568. Typically, after operator 522 inputs the route identification data and has visited each of the checkpoints required for the safety inspection (thereby collecting the other data), the operator can transmit the data set (comprising the route identification data and the other data/inspection data) that have been collected during the inspection to remote data storage site 561 through an RF transmission via antenna 544. The data provide evidence that the operator has visited the components and indicated the state and condition of the components that were visited and inspected and also provide an indication upon which one of the plurality of predefined routes the vehicle has been operated to be specifically identified, generally as discussed above with respect to the method of FIG. 1. Alternatively, optional USB port 548 on portable device 520 can be coupled to a network interface 563 on an external cradle or docking station (an example of which is described below in connection with FIG. 5D), which is in communication with remote data storage 565, as shown in FIG. 5B. In FIG. 5C, CPU 562 is shown communicating data to transmitter 566 (or through another data link) using a wired and/or wireless data communication link. The data collected and stored (in memory 564 of portable device 520) during the safety inspection can thus be safely transferred to the remote data storage site and retained for as long as the data might be needed.

In some cases, it may be preferable to transmit the data to the remote site immediately after making a safety inspection to ensure that the data retained in memory 564 are not lost should an accident occur that destroys portable device 520. An accident destroying the evidence that the safety inspection was implemented could have an adverse effect during any litigation related to the accident, which might allegedly have been caused by one of the components that was purported to have been inspected. However, since the risk of such an accident is relatively remote, it is contemplated that an operator may collect the data from a number of safety inspections in memory 564 and then subsequently upload the data to remote data storage 565 by coupling the portable device to the external cradle or docking station that includes a USB port terminal and network interface that facilitates connecting via the Internet or other network, to a remote storage, generally as indicated in FIG. 5D. The cradle or docking station might be maintained by a carrier at a freight terminal, which is at least periodically visited by the truck that was inspected. Alternatively, the external cradle or docking station might be disposed at a different site and/or connect to the remote data storage site through other types of communication links. One example of such a communication system is the OMNITRACS™ satellite mobile communication system sold by Qualcomm Corporation that enables drivers on the road and carriers to remain in communication with each other and enables the carrier to monitor the location of a tractor-trailer during a trip. By linking portable device 520 through USB port 548 to such a data communication system, the data stored within memory 564 can readily be transmitted to a remote site maintained by the carrier for long-term storage, even while a trip by the tractor-trailer is in progress.

FIG. 5D is a schematic diagram of the system for transferring a data set from a portable electronic data collection device over the Internet, between the portable electronic data collection device in the docking station and storage on a remote computing device. Docking station 529 includes an interface circuit that couples the data port on portable device 520 to a personal computer 554 through a data link 531. In this exemplary embodiment, the interface circuit converts the data format of portable device 520 to a format compatible with data link 531, which is connected to an input port of remote computer 554. It is contemplated that docking station 529 might be disposed in a terminal or other location to which the portable device is returned between inspections or at other times, to transfer data from the memory within the portable device to remote storage on remote computer 554.

The tokens that are affixed at various points on the tractor-trailer (or adjacent components of other types of systems or apparatus unrelated to a vehicle) can be of several different types, depending upon the type of sensor 546 that is included on portable device 520. In at least one exemplary embodiment, the token that is employed is an RF identification (RFID) tag that is attached with a fastener or an appropriate adhesive to a point on a frame or other support (not shown) adjacent to the component associated with the token. One type of RFID tag that is suitable for this purpose is the WORLDTAG™ token that is sold by Sokymat Corporation. This tag is excited by an RF transmission from portable device 520 via antenna 544. In response to the excitation energy received, the RFID tag modifies the RF energy that is received from antenna 544 in a manner that specifically identifies the component associated with the RFID tag, and the modified signal is detected by sensor 546. An alternative type of token that can also be used is an IBUTTON™ computer chip, which is armored in stainless steel housing and is readily affixed to a frame or other portion of the vehicle (or other type of apparatus or system), adjacent to the component associated with the IBUTTON chip. The IBUTTON chip is programmed with JAVA™ instructions to provide a recognition signal when interrogated by a signal received from a nearby transmitter, such as from antenna 544 on portable device 520. The signal produced by the IBUTTON chip is received by sensor 546, which determines the type of component associated with the token. This type of token is less desirable since it is more expensive, although the program instructions that it executes can provide greater functionality.

Yet another type of token that might be used is an optical bar code in which a sequence of lines of varying width or of other distinctive characteristic encodes light reflected from the bar code tag. The encoded reflected light is received by sensor 546, which is then read by an optical detector. Bar code technology is well understood in the art and readily adapted for identifying a particular type of component and location of the component on a vehicle or other system or apparatus. One drawback to the use of a bar code tag as a token is that in an exposed location, the bar code can be covered with dirt or grime that must be cleaned before the sequence of bar code lines can be properly read. If the bar code is applied to a plasticized adhesive strip, it can readily be mounted to any surface and then easily cleaned with a rag or other appropriate material.

Still another type of token usable in the present approach is a magnetic strip in which a varying magnetic flux encodes data identifying the particular component associated with the token. Such magnetic strips are often used in access cards that are read by readers mounted adjacent to doors or in an elevator that provides access to a building. However, in the present approach, the magnetic flux reader comprises sensor 546 on portable device 520. The data encoded on such a token are readily read as the portable device is brought into proximity with the varying magnetic flux encoded strip comprising the token. As a further alternative, an active token can be employed that conforms to the BLUETOOTH™ specification for short distance data transfer between computing devices using an RF signal. However, it is likely that the range of the signal transmitted by the token would need to be modified so that it is substantially less than that normally provided by a device conforming to the BLUETOOTH specification. It is important that the portable device be able to detect that it is proximate to the component within a predetermined maximum range selected to ensure that the operator is positioned to actually carry out an inspection of the component.

FIG. 6 is a functional block diagram showing how a plurality of functional elements, different than those illustrated in FIGS. 4A-4D, can be configured to also implement the method steps of FIG. 3. A vehicle 34 includes a GPS unit 40 (with a transmitter, i.e., a wireless data link), one or more sensors 38 for collecting data relating to an operational status of the vehicle, and route identification data input 24 that can be used by an operator to input the route identification data as discussed in detail above. Data input 24 and sensors 38 are logically coupled to GPS unit 40, which is configured to produce a data set comprising the route identification data, the sensor data, and the geographic positional data. That data set can be transmitted to a remote computing device for processing to identify the route identification data, thereby determining upon which one of the plurality of predefined routes the vehicle was operating while the data set was generated.

As noted above, the data set can be transmitted in real-time, or after a specific route has been finished. GPS unit 40 can be electrically coupled to ignition system 36, such that geographical position data is only collected while the ignition system is on (indicating that the vehicle is likely to be moving, because fleet operators actively attempt to limit the amount of engine idle time, i.e., the time a vehicle's engine is running but the vehicle is not moving—to conserve fuel and reduce engine wear). It should be noticed that the additional data in the data set (i.e., the data that is not route identification data) can comprise either data collected from the sensors or geographical position data collected, rather than a combination of both. If the data set comprises route identification data and geographical position data, the sensors (and the data they collect) are not required. If the data set comprises route identification data and sensor data, then the GPS unit is not required, so long as some other suitable data link (a wireless transmitter or some other data link generally as described above) is provided to enable the data set to be conveyed to the remote computing device for analysis.

With respect to the first primary embodiment wherein a data set comprises route identification data and other data, it should be recognized that a wide variety of other data can be collected that relates to the operation of a vehicle. U.S. patent application Ser. No. 11/247,953, entitled ENSURING THE PERFORMANCE OF MANDATED INSPECTIONS COMBINED WITH THE COLLECTION OF ANCILLARY DATA (the specification and drawings of which have been are hereby specifically incorporated herein by reference), provides a detailed description of ancillary data that can be collected.

FIG. 7 is a flow chart showing method steps implemented in a second primary embodiment, in which the data being analyzed comprise geographical position data collected from the vehicle during the vehicle's operation, which is then compared to geographical position data corresponding to a plurality of the predefined routes, enabling the route over which the vehicle has been operated during collection of the geographical position data to be identified. In a block 42, a plurality of predefined routes are defined using the positional data to generate a fingerprint (i.e., a collection of data points uniquely defining a specific route). Each fingerprint can comprise geographic positional data, or some combination of geographical position data and temporal data. The incorporation of temporal data facilitates distinguishing one fingerprint from another when each fingerprint shares one or more geographical positions in common. For example, many bus routes may share one or more common geographical positions. The temporal component will help facilitate distinguishing fingerprints sharing common geographical position data from one another.

In a block 44, geographical position data (preferably GPS data, although it should be recognized that data from other geographic position tracking-based systems can be used, and the concepts presented herein are not intended to be limited to the use of GPS data alone) are collected from the vehicle while the vehicle is traversing a predefined route. In a block 46, the GPS data from the vehicle are analyzed to determine which route fingerprint most closely matches the GPS data collected from the vehicle, thereby enabling a determination to be made regarding upon which one of the plurality of predefined routes the vehicle was operating while the GPS data were being collected. As noted above, such an analysis is often performed by a remote computing device, and some type of data link would then be required to transmit the GPS data from the vehicle to the remote computer. The data link can be implemented in real-time, i.e., while the GPS data are being collected, or the GPS data can be conveyed to the remote computing device after a trip has been completed. Of course, these data must include some identifier that uniquely identifies the specific vehicle, so that GPS data collected from different vehicles can be distinguished from one another.

FIG. 8 is a schematic block diagram of exemplary functional components employed to implement the method steps of FIG. 7. The elements include a GPS unit 50, a transmitter 52 (or other data link), and a remote computing device 54 (generally as described above). It should be recognized that many GPS units are available that already incorporate a transmitter, such that a separate transmitter may not be required.

FIG. 9 is a schematic block diagram of an exemplary vehicle configured to collect the geographical position data employed in the method steps of FIG. 7. A vehicle 26*a* includes GPS unit 40 (which in this embodiment, includes a transmitter, although it should be recognized that a GPS unit without a transmitter can be coupled with a transmitter or other data link to achieve similar functionality). GPS unit 40 is coupled to ignition system 36, such that geographical position data are collected only when the ignition system is on, but this configuration is not required.

FIG. 10 is a flow chart showing method steps implemented to generate a fingerprint comprising geographical position data for each one of the plurality of predefined routes, so that the fingerprints can be compared to the geographical position data collected from a vehicle to identify upon which one of the plurality of predefined routes the vehicle traveled while the geographical position data were collected. In a block 60, a vehicle is equipped with geographical position sensors (such as a GPS unit), so that geographical position data can be collected when the vehicle is being operated. In a block 62, the vehicle is operated over a specific route with the GPS unit activated, to collect geographical position data corresponding to the specific route. In a block 64, the GPS data collected are stored as a fingerprint for the route, and the process is repeated until a fingerprint has been generated for each one of the plurality of predefined routes.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A method for automatically determining which of a plurality of predefined routes a vehicle has traveled, comprising the steps of:

(a) collecting data at the vehicle in conjunction with operation of the vehicle, wherein the data collected include:

(i) data that includes a route identifier specifying which one of the plurality of predefined routes the vehicle has traversed or is to during operation of the vehicle, and data that includes other data comprising vehicle inspection data, the step of collecting data comprising the step of providing vehicle inspection data collected by an operator of the vehicle using a portable data collection device configured to facilitate input of the vehicle inspection data that indicate a status of the vehicle, wherein the vehicle inspection data comprises token data collected by the portable data collection device from a plurality of tokens disposed proximate inspection locations associated with the vehicle, wherein the tokens and the inspection locations are disposed on the vehicle, the token data providing evidence that the operator was proximate the token during the vehicle inspection; and (ii) vehicle geographical position data collected from the vehicle during operation of the vehicle;

(b) after completing the predefined route, conveying the data collected at the vehicle to a remote computing device for analysis to determine which one of the plurality of predefined routes the vehicle has traveled; and (c) automatically analyzing the data collected in conjunction with operation of the vehicle to determine along which one of the plurality of predefined routes the vehicle has traveled, and storing the predefined route that is identified, for later retrieval or display to a user, the step of automatically analyzing comprising the steps of:

(i) automatically determining if the data collected in conjunction with operation of the vehicle include the route identifier that specifies which one of the plurality of predefined routes the vehicle has traveled, thereby identifying the specific one of the plurality of predefined routes the vehicle has traveled based on the route identifier; and (ii) automatically determining if the data collected in conjunction with operation of the vehicle include vehicle geographical position data, and if so, comparing the vehicle geographical position data with a plurality of route fingerprints, each route fingerprint corresponding to one of the plurality of predefined routes, to determine which one of the route fingerprints corresponds to the vehicle geographical position data, thereby identifying the specific one of the plurality of predefined routes the vehicle has traveled based on the vehicle geographical position data and its corresponding route fingerprint.

2. The method of claim 1, wherein the step of collecting data in conjunction with operation of the vehicle comprises the step of enabling an operator of the vehicle to provide the route identifier data.

3. The method of claim 1, wherein the step of conveying the data collected to the remote computing device for analysis comprises the step of conveying the data collected from at least one of:

(a) a portable data collection device configured to be used by the operator of the vehicle; and (b) a data collection device disposed in the vehicle.

4. The method of claim 1, further comprising the step of the generating each route fingerprint by:

(a) equipping a vehicle with a geographical position data sensor; and (b) traveling one of the predefined routes with the vehicle equipped with the geographical position data sensor, thereby generating a route fingerprint for said one of the predefined routes.

5. A memory medium having machine instructions stored thereon for carrying out step (c) of claim 1.

6. A system for automatically determining which one of a plurality of predefined routes a vehicle has traveled, comprising:

(a) a memory in which a plurality of machine instructions are stored;

(b) a data link for conveying data collected in conjunction with operation of the vehicle; and (c) a processor, coupled to the memory and to the data link, said processor being remote from the vehicle, wherein the data collected must be conveyed from a data collection device associated with the vehicle to the processor for analysis, the processor executing the machine instructions to carry out a plurality of functions, including:

(i) automatically analyzing the data collected in conjunction with operation of the vehicle that are received via the data link to determine which one of the plurality of predefined routes the vehicle has traveled using the techniques of:

(A) automatically determining if the data collected in conjunction with operation of the vehicle includes token data collected by a portable data collection device from a plurality of tokens disposed proximate inspection locations associated with the vehicle, wherein the tokens and the inspection locations are on the vehicle, the token data providing evidence that the operator was proximate the token during the vehicle inspection, and if so, parsing the data to identify a route identifier that specifies which one of the plurality of predefined routes the vehicle has traveled, thereby identifying the specific one of the plurality of predefined routes the vehicle has traveled based on the route identifier; and (B) automatically determining if the data collected in conjunction with operation of the vehicle comprises vehicle geographical position data, and if so, comparing the vehicle geographical position data with a plurality of route fingerprints, each route fingerprint corresponding to one of the plurality of predefined routes, to determine which one of the route fingerprints corresponds to the vehicle geographical position data, thereby identifying the specific one of the plurality of predefined routes the vehicle has traveled based on the vehicle geographical position data and its corresponding route fingerprint.

7. A method for automatically determining which one of a plurality of predefined routes a vehicle has traveled, comprising the steps of:

(a) collecting data at the vehicle in conjunction with operation of the vehicle;

(b) conveying the data collected at the vehicle to a remote computing device for analysis to determine which one of the plurality of predefined routes the vehicle has traveled;

(c) after the vehicle has completed its travel, automatically analyzing the data collected in conjunction with operation of the vehicle to determine if the data collected includes a route identifier that specifies which one of the plurality of predefined routes the vehicle has traveled, thereby identifying the specific one of the plurality of predefined routes the vehicle has traveled based on the route identifier, storing the predefined route for later retrieval or display to a user; and (d) where the data collected in conjunction with operation of the vehicle does not comprise a route identifier that specifies the route the vehicle has traversed, automatically analyzing the data collected in conjunction with operation of the vehicle to:

(i) identify vehicle geographical position data from the data collected in conjunction with operation of the vehicle;

(ii) compare the vehicle geographical position data with a plurality of different route fingerprints, where each different route fingerprint comprises geographical position data corresponding to a specific one of the plurality of predefined routes; and (iii) determine which route fingerprint corresponds to the vehicle geographical position data, thereby identifying the specific one of the plurality of predefined routes the vehicle has traversed based on the vehicle geographical position data and the route fingerprint, and storing the predefined route that was identified for later retrieval or display to a user.

8. The method of claim 7, further comprising the step of generating each route fingerprint by:

(a) equipping a vehicle with a geographical position data sensor; and (b) traversing each one of the plurality of predefined routes with the vehicle equipped with the geographical position data sensor, so that the geographical position data sensor generates a route fingerprint for each one of the plurality of the predefined routes.

9. A memory medium having machine instructions stored thereon for carrying out steps (b) and (c) of claim 7.

10. A method for automatically determining which of a plurality of predefined routes a vehicle has traveled, comprising the steps of:

(a) collecting data at the vehicle in conjunction with operation of the vehicle, wherein the data collected include:

(i) data that includes a route identifier in addition to other data, the route identifier specifying which one of the plurality of predefined routes the vehicle has traveled during operation of the vehicle, other data including token data collected by a portable data collection device from a plurality of tokens disposed proximate inspection locations associated with the vehicle, wherein the tokens and the inspection locations are disposed on the vehicle, the token data providing evidence that the operator was proximate the token during a vehicle inspection; and (ii) vehicle geographical position data collected from the vehicle during operation of the vehicle;

(b) conveying the data collected at the vehicle to a remote computing device for analysis to determine which one of the plurality of predefined routes the vehicle has traveled; and (c) automatically analyzing the data collected in conjunction with operation of the vehicle to determine along which one of the plurality of predefined routes the vehicle has traveled, and storing the predefined route that is identified, for later retrieval or display to a user, the step of automatically analyzing comprising the steps of:

(i) automatically determining if the data collected in conjunction with operation of the vehicle include the route identifier that specifies which one of the plurality of predefined routes the vehicle has traversed, thereby identifying the specific one of the plurality of predefined routes the vehicle has traversed based on the route identifier; and (ii) automatically determining if the data collected in conjunction with operation of the vehicle include vehicle geographical position data, and if so, comparing the vehicle geographical position data with a plurality of route fingerprints, each route fingerprint corresponding to one of the plurality of predefined routes, to determine which one of the route fingerprints corresponds to the vehicle geographical position data, thereby identifying the specific one of the plurality of predefined routes the vehicle has traveled based on the vehicle geographical position data and its corresponding route fingerprint.

* * * * *